US011268687B2

(12) United States Patent
Zhang et al.

(10) Patent No.: US 11,268,687 B2
(45) Date of Patent: Mar. 8, 2022

(54) LED SCREEN

(71) Applicant: SHENZHEN GLOSHINE TECHNOLOGY CO., LTD., Guangdong (CN)

(72) Inventors: Xianfeng Zhang, Guangdong (CN); Yongjun Zhang, Guangdong (CN); Guoqiang Li, Guangdong (CN); Zhiqiang Gao, Guangdong (CN)

(73) Assignee: SHENZHEN GLOSHINE TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/632,868

(22) PCT Filed: Oct. 16, 2019

(86) PCT No.: PCT/CN2019/111435
§ 371 (c)(1),
(2) Date: Jan. 21, 2020

(87) PCT Pub. No.: WO2020/098440
PCT Pub. Date: May 22, 2020

(65) Prior Publication Data

US 2021/0063009 A1 Mar. 4, 2021

(30) Foreign Application Priority Data

Nov. 16, 2018 (CN) ..... 201811368216.8

(51) Int. Cl.
*F21V 31/00* (2006.01)
*F21V 29/83* (2015.01)
*G09F 9/33* (2006.01)

(52) U.S. Cl.
CPC ..... *F21V 31/005* (2013.01); *F21V 29/83* (2015.01); *G09F 9/33* (2013.01)

(58) Field of Classification Search
CPC ..... F21V 31/005; F21V 29/83; G09F 9/33
See application file for complete search history.

(56) References Cited

U.S. PATENT DOCUMENTS 8,974,077 B2 * 3/2015 Auyeung ..... F21V 29/76 362/218
2009/0262492 A1 * 10/2009 Whitchurch ..... G06F 3/0202 361/679.08

(Continued)

FOREIGN PATENT DOCUMENTS

CN 201829141 U 5/2011
CN 103035175 A 4/2013

*Primary Examiner* — Bryon T Gyllstrom
*Assistant Examiner* — Christopher E Dunay

(57) ABSTRACT

Provided is an LED Screen, comprising a box frame and a display unit fixed in the box frame, wherein the display unit comprises a PCB board and a plurality of LED lamp beads fixed on the PCB board, the front and back of the display unit are covered with transparent waterproof membranes, which can play a waterproof role and avoid short circuit of the display unit; Waterproof membranes can also play a role in protecting the LED lamp beads and PCB board, preventing external objects from damaging the beads, and the PCB board from being corroded. Transparent waterproof membrane is easier for the light emitted from LED Lamp beads to pass through, so the PCB board installed with LED lamp beads and covered with waterproof membranes can be directly fixed on the box frame, and can be used, the PCB board can be directly maintained, which is simple and convenient.

8 Claims, 3 Drawing Sheets

(56) References Cited

U.S. PATENT DOCUMENTS

| | | | | |
|---|---|---|---|---|
| 2011/0051409 | A1* | 3/2011 | Nearman | F21V 31/005 362/231 |
| 2014/0259634 | A1* | 9/2014 | Cox | G09F 19/228 29/592.1 |
| 2016/0003454 | A1* | 1/2016 | Ye | F21V 29/76 362/268 |
| 2016/0245491 | A1* | 8/2016 | Kim | H05K 1/0274 |
| 2017/0067618 | A1* | 3/2017 | Wagatsuma | F21V 19/0015 |
| 2017/0175962 | A1* | 6/2017 | Kim | F21V 31/005 |
| 2020/0240600 | A1* | 7/2020 | Ho | F21S 4/24 |
| 2020/0341333 | A1* | 10/2020 | Qiu | H01L 33/62 |

* cited by examiner

LED SCREEN

TECHNICAL FIELD

The application belongs to the technical field of LED Screen, in particular to an LED Screen.

BACKGROUND

With the development of society, LED Screen has been applied more and more widely in our life. LED Screen has been integrated into many aspects of our life.

LED Screen is a flat panel display, which is used to display information such as text, images, videos and video signals. Because LED Screen can be extended as needed, seamlessly spliced, and uses interactive technology, it has good display effect and long operation time, it is widely used in airports, shopping malls, hotels, high-speed rail, subway, cinemas, exhibitions, office buildings and other places.

LED Screen generally includes a number of LED lamp beads, PCB board and box frame. LED lamp beads are welded to PCB board, and PCB board is fixed to box frame. When in use, the box frame is fixed, or the box frames are spliced then fixed. When power is applied to the PCB board, the LED lamp beads on the PCB board will emit light; Since there are many dense LED lamp beads, the lights emitted by the LED lamp beads fixed on the PCB board get together, making the information appearing in people's visual field become a whole, thus displaying the graphic information.

Because LED lamp beads are fragile and easily damaged, there are currently two types of LED screens on the market to protect LED lamp beads. One is to set up a front panel and a back panel respectively on both sides of the PCB board to protect the PCB board between the front panel and the back panel. The other is that after the LED lamp beads are encapsulated with glue solution to form a protective layer, the LED lamp beads are sealed and fixed in the protective layer, the protective layer is a thick transparent adhesive layer, and the side of the protective layer close to the PCB board and the side facing away from the PCB board are both flat. When the LED lamp beads are damaged or other problems incurred, it is inconvenient for these two types of LED Screens to be maintained, which increases the maintenance cost, and the production cost is also high due to the higher technological requirements.

Usually, after the pins of LED lamp beads are welded on the PCB board, the pins of LED lamp beads will not be subjected to any other treatment. In case of collision with external force, the pins of LED lamp beads may be separated from the solder joints on the PCB board, thus knocking the LED lamp beads off the PCB board and creating a display vacuum area.

When the existing LED Screen is fixed outdoors, the whole LED Screen is windtight, and when the wind blows, the surface of the whole LED Screen is stressed, so the requirement for fixing the LED Screen is high, and the LED Screen is easy to be blown down by the wind.

SUMMARY

The application aims to provide an LED Screen to solve the technical problem of inconvenient maintenance of the LED Screen in the prior Art.

To achieve the above purpose, the technical solution adopted by the present application is to provide an LED Screen, comprising a box frame and a display unit fixed in the box frame, wherein the display unit comprises a PCB board and a plurality of LED lamp beads fixed on the PCB board, the front and back of the display unit are covered with transparent waterproof membranes.

Further, the LED Screen of claim 1, further comprising an adhesive, wherein the adhesive is positioned around and at the bottom of the LED lamp beads, and is used for bonding the LED lamp beads and PCB board.

Further, the PCB board is provided with a plurality of through holes, and the LED lamp beads are set to avoid the through holes.

Further, the thickness of the parts of the waterproof membrane covering each LED lamp bead are the same.

Further, the thickness of the waterproof membrane is 5 μm-20 μm.

Further, the LED lamp beads are distributed on the PCB board in an array, and the LED lamp beads in the same row in a length direction of the PCB board are arranged at equal intervals, the LED lamp beads in the same column in a width direction of the PCB board are arranged at equal intervals.

Further, the through hole extends along a width direction or a length direction of the PCB board, and the extension length is at least the distance between two LED lamp beads.

Further, the through holes are arranged between any two adjacent rows of LED lamp beads, or the through holes are arranged between any two adjacent columns of LED lamp beads.

Further, the LED Screen also comprises a control rack, box stiffener, positioning pin, hoisting lock, handle, spring lock and angle block, the control rack is arranged in the middle in a length direction of the box frame, the control rack is provided with a control device, the box stiffeners are connected with two frame edges in a width direction of the box frame, and the positioning pin, the hoisting lock and the handle are all arranged on one frame edge in the width direction of the box frame; the spring lock is arranged on one frame edge in the length direction of the box frame, the angle block is arranged on the other frame edge in the length direction of the box frame, and when two box frames are spliced, the spring lock of one box frame cooperates with the angle block of the other box frame to lock the two box frames.

Further, the LED Screen also comprises a waterproof & heat-conducting pad, wherein the waterproof & heat-conducting pad is arranged between the PCB board and the box frame, and the waterproof & heat-conducting pad is embedded at one side of the PCB board facing the control device.

The LED Screen provided by the application has the beneficial effects that, compared with the prior art, the front and back of the display unit of the LED Screen provided by the application are both covered with waterproof membranes, which can play a waterproof role and avoid short circuit of the display unit; Waterproof membrane can also play a role in protecting the LED lamp beads and PCB board, preventing external objects from damaging the LED lamp beads, and the PCB board from being corroded. Transparent waterproof membrane is easier for the light emitted by LED Lamp beads to pass through, so the PCB board installed with LED lamp beads and covered with waterproof membranes can be directly fixed on the box frame, and can be used, the PCB board can be directly maintained, which is simple and convenient.

BRIEF DESCRIPTION OF DRAWINGS

In order to more clearly explain the technical solution in the embodiments of the present application, a brief description of the drawings of the embodiments or the prior art is provided below. It is readily apparent that the following description of the drawings are only for some embodiments of the present application. For those of ordinary skill in the art, other drawings can be obtained according to these drawings without the exercise of inventive faculty.

In the figures.

Figure 1:
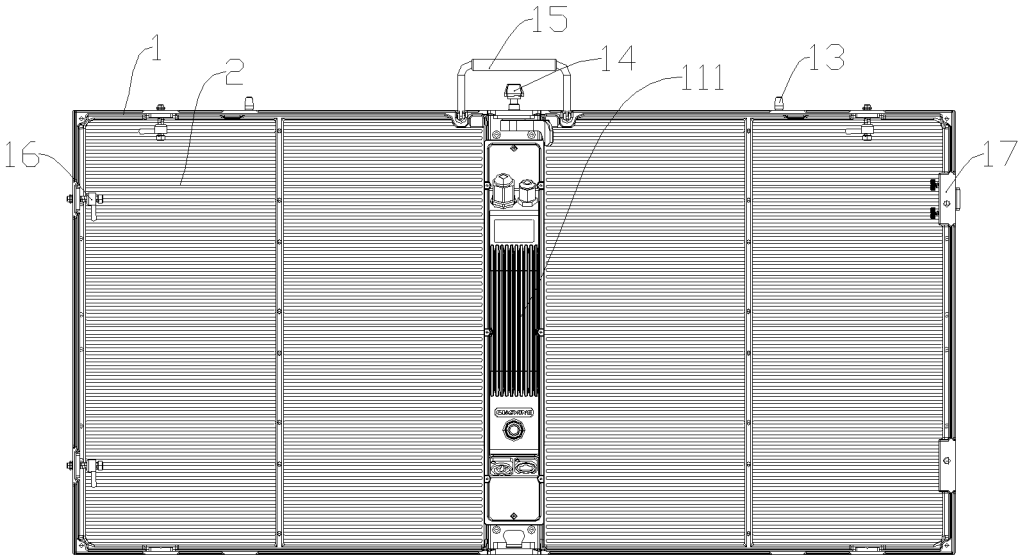
FIG. 1 is a structural schematic diagram of the LED Screen provided by an embodiment of the present application.

1. Box Frame; 11. Control Rack; 111. Control Device; 12. Box Stiffener; 13. Positioning Pin; 14. Hoisting Lock; 15. Handle; 16. Spring Lock; 17. Angle Block;

2. Display Unit; 21. PCB Board; 22. LED Lamp Beads; 211. Through Hole;

3. Waterproof Membrane; 4. Adhesive; 5. Waterproof & Heat-conducting Pad.

DETAILED DESCRIPTION OF EMBODIMENTS

In order to make the to-be-solved technical problems, technical solutions and beneficial effects of the present application more clear, the present application will be described in further detail below with reference to the drawings and embodiments. It should be understood that the specific embodiments described herein are only for the purpose of explaining the present application and are not intended to limit the present application.

It should be noted that when an element is referred to as being "fixed" or "disposed" on another element, it may be directly on the other element or indirectly on the other element. When an element is referred to as being "connected" to another element, it may be directly connected to the other element or indirectly connected to the other element.

It should be understood that the terms "length", "width", "upper", "lower", "front", "rear", "left", "right", "vertical", "horizontal", "top", "bottom", "inner", "outer" and the like indicate the orientation or positional relationship based on the orientation or positional relationship shown in the drawings, only for convenience of describing the present application and simplifying the description, and do not indicate or imply that the said device or element must have a specific orientation, be constructed or operated in a specific orientation, and therefore cannot be understood as a limitation of the present application.

In addition, in the description of the present application, the meaning of "plurality" is two or more unless otherwise specifically indicated.

Figure 3:
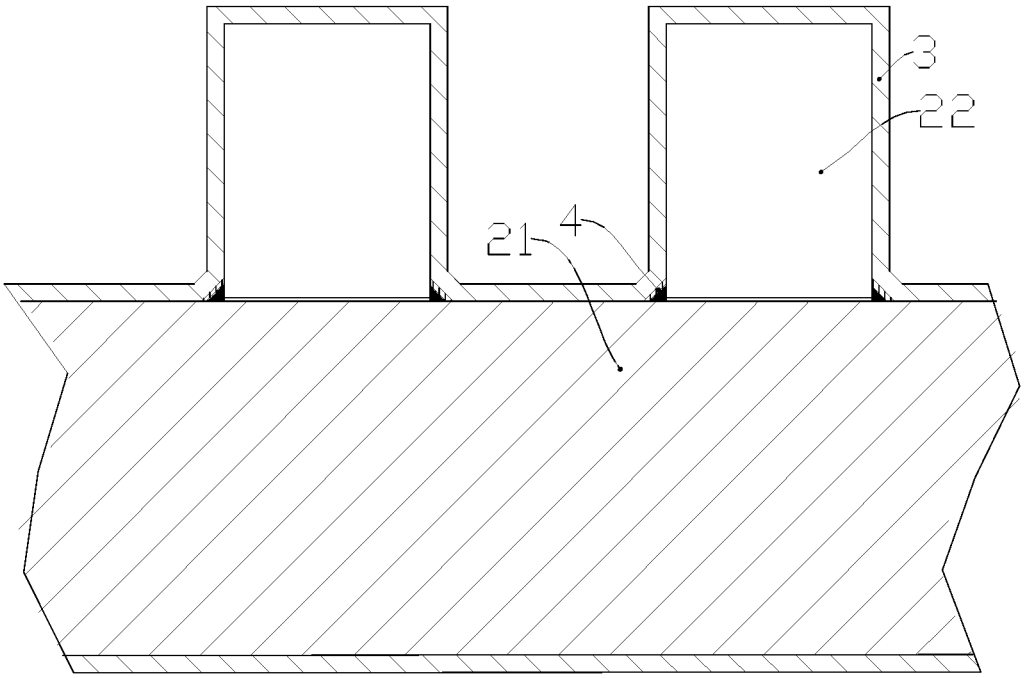
FIG. 3 is a partial sectional view of FIG. 1.

Referring to FIGS. 1 and 3, the LED Screen provided by the present application will now be described. An LED Screen, comprising a box frame 1 and a display unit 2 fixed in the box frame 1, wherein the display unit 2 comprises a PCB board 21 and a plurality of LED lamp beads 22 fixed on the PCB board 21, the front and back of the display unit 2 are covered with transparent waterproof membranes 3.

Compared with the prior art, the LED Screen provided by the application has the advantages that the front surface and the back surface of the display unit 2 are covered with the waterproof membranes 3, which can play a waterproof role and avoid short circuit of the display unit 2; Waterproof membrane 3 can also play a role in protecting the LED lamp beads 22 and PCB board 21, preventing external objects from damaging the LED lamp beads 22, and the PCB board 21 from being corroded. Transparent waterproof membrane 3 is easier for the light emitted by LED Lamp beads to pass through, so the PCB board 21 installed with LED lamp beads 22 and covered with waterproof membranes 3 can be directly fixed on the box frame 1, and can be used, the PCB board 21 can be directly maintained, which is simple and convenient.

Specifically, the waterproof membrane 3 is formed by coating glue on the entire surfaces of PCB board 21 and LED lamp beads 22.

Further, referring to FIG. 3, as a specific embodiment of the LED Screen provided by the present application, the LED screen further comprises an adhesive 4, wherein the adhesive 4 is positioned around and at the bottom of the LED lamp beads 22, and the LED lamp beads 22 and the PCB board 21 are bonded, so that the adhesive force of the LED lamp beads 22 is enhanced, and the LED lamp beads 22 fixed on the PCB board 21 can be prevented from loosening and falling off the PCB board 21.

Specifically, the LED lamp beads 22 on the PCB board 21 are often knocked against and loosened, so the LED lamp beads 22 often fall off the PCB board 21. To apply adhesive 4 around and at the bottom of the LED lamp beads 22 and the PCB board 21 can effectively prevent the occurrence of such a situation.

Further, referring to FIG. 1, as a specific embodiment of the LED Screen provided by the present application, the PCB board 21 is provided with a plurality of through holes 211, and the LED lamp beads 22 are set to avoid the through holes 211. When the PCB board 21 is fixed for outdoor use, the force-bearing area of the PCB board 21 blown by the wind can be effectively reduced, thus preventing the PCB board 21 from being blown down by the wind due to excessive force.

Further, referring to FIG. 3, as a specific embodiment of the LED Screen provided by the present application, the thickness of the parts of the waterproof membrane covering each LED lamp bead are the same, which ensures the same effect when the lights emitted by the LED lamp beads 22 pass through their corresponding waterproof membranes 3 of each LED lamp bead 22, and avoids the situation that the display effect of the LED Screen is reduced due to the different light intensities emitted by a plurality of LED lamp beads 22.

Further, as a specific embodiment of the LED Screen provided by the present application, the thickness of the waterproof membrane 3 is 5 μm-20 μm, which ensures that the waterproof membrane 3 can play a role in waterproofing and protecting the LED lamp beads 22 and PCB board 21, and also ensures that the light emitted from the LED lamp beads 22 has a better visual effect after passing through the waterproof membrane 3.

Preferably, the thickness of the waterproof membrane 3 is 10 μm-15 μm, and the waterproof membrane 3 in this thickness range has better waterproof and protective effects.

Further, as a specific embodiment of the LED Screen provided by the present application, each LED lamp bead 22 is distributed on the PCB board 21 to form an array, and the LED lamp beads 22 in the same row in a length direction of the PCB board are arranged at equal intervals, the LED lamp beads 22 in the same column in a width direction of the PCB board are arranged at equal intervals, so that the light emitted by the LED lamp beads 22 arranged in this way has better effect when displayed on the LED Screen.

Further, referring to FIG. 1, as a specific embodiment of the LED Screen provided by the present application, the through hole 211 extends along a width direction or a length direction of the PCB board 21, and its extension length is at least the distance between two LED lamp beads 22, which increases the area of the through holes 211, reduces the stress area of the PCB board 21, and prevents the PCB board 21 from being blown down due to excessive stress.

Specifically, the through hole 211 also has a heat dissipation function.

Further, referring to FIG. 1, as a specific embodiment of the LED Screen provided by the present application, the through holes 211 are arranged between any two adjacent rows of LED lamp beads 22, or the through holes 211 are arranged between any two adjacent columns of LED lamp beads 22. The reasonable distribution of LED lamp beads 22 and through hole 211 on PCB board 21 prevents the LED lamp beads 22 from being too sparsely distributed to affect the display effect of LED Screen, or the LED lamp beads 22 from being too densely distributed to increase the production cost. And the area of through holes 211 is increased to reduce the stress area of LED Screen.

Figure 2:
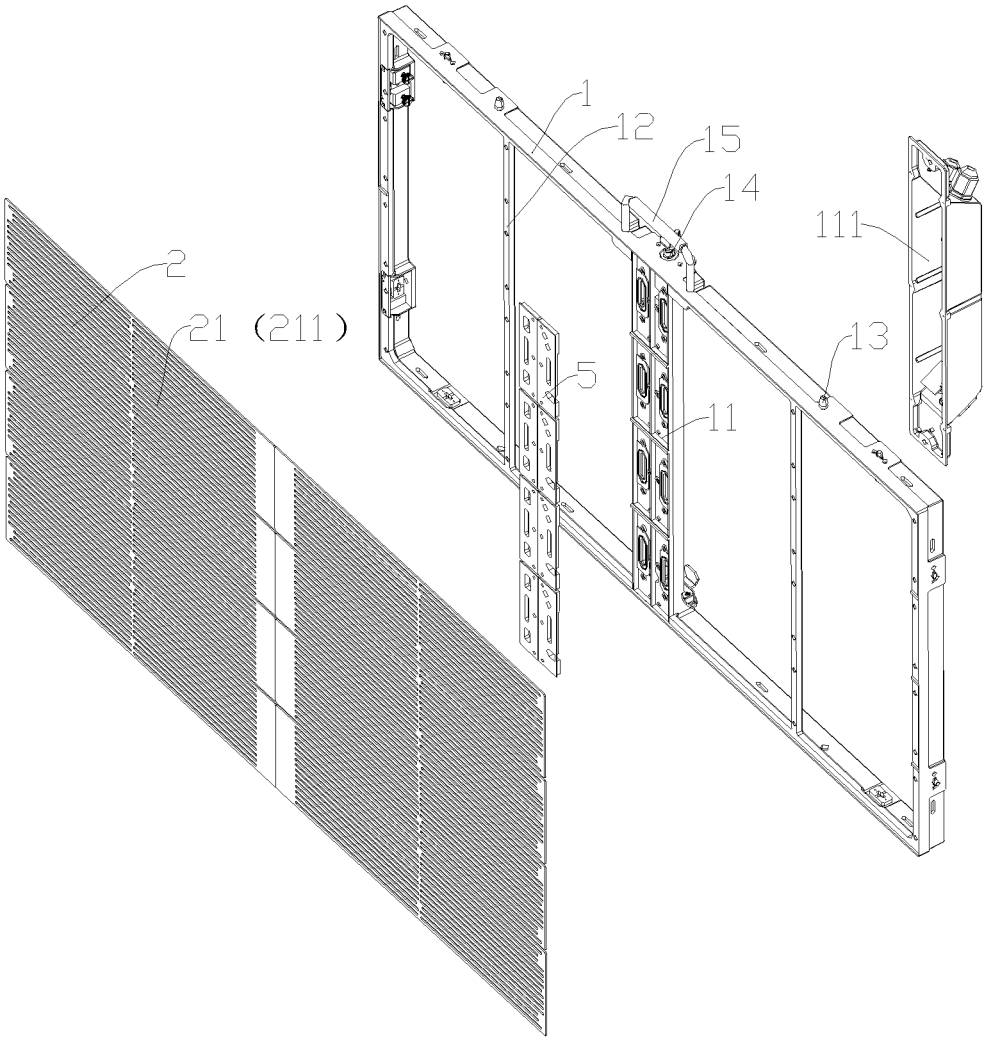
FIG. 2 is an exploded view of FIG. 1.

Further, referring to FIGS. 1 and 2, as a specific embodiment of the LED Screen provided by the present application, the LED Screen further comprises a control rack 11, box stiffener 12, positioning pin 13, hoisting lock 14, handle 15, spring lock 16 and angle block 17, the control rack 11 is arranged in the middle in a length direction of the box frame 1, the control rack 11 is provided with a control device 111, the box stiffeners 12 are connected with two frame edges in a width direction of the box frame 1, and the positioning pin 13, the hoisting lock 14 and the handle 15 are all arranged on one frame edge in the width direction of the box frame 1; the spring lock 16 is arranged on one frame edge in the length direction of the box frame 1, the angle block 17 is arranged on the other frame edge in the length direction of the box frame 1, and when the two box frames 2 are spliced, the spring lock 16 of one box frame 1 cooperates with the angle block 17 of the other box frame 1 to lock the two box frames 1.

Box stiffener 12 can increase the overall stress strength of the box and support the PCB board 21; When in use, the positioning pin 13 can be installed in two adjacent box frames 1 and position the two box frames 1, so it is easy to assemble the box frames 1; When assembling the box frames 1, the spring lock 16 on one box frame 1 is connected to the angle block 17 on the other box frame 1, which can connect the two box frames 1 and adjust the angle between the two box frames 1; The handle 15 facilitates to lift the box frame 1; The control device 111 is used to provide power and control signals to the PCB board 21.

Specifically, the control device 111 includes a power line, a signal line, and a control button.

Further, referring to FIG. 2, as a specific embodiment of the LED Screen provided by the present application, the LED screen further comprises a waterproof & heat-conducting pad 5, wherein the waterproof & heat-conducting pad 5 is arranged between the PCB board 21 and the box frame 1. Moreover, the waterproof & heat-conducting pad 5 is embedded on the side of the PCB board 21 facing the control device 111, which facilitates the control device 111 to dissipate heat through the heat-transfer character of the waterproof & heat-conducting pad 5.

Further, unless otherwise required by context, singular terms shall include pluralities and plural terms shall include the singular. Thus, as used herein and in the claims, the singular forms include the plural reference and vice versa unless the context clearly indicates otherwise.

The above descriptions are only preferred embodiments of the present application and are not intended to limit the present application. Any modification, equivalent substitution and improvement made within the spirit and principles of the present application shall be included within the scope of protection of the present application.

What is claimed is:

1. An LED screen for outdoor use, comprising a box frame and a display unit fixed in the box frame, wherein the display unit comprises a PCB board and a plurality of LED lamp beads fixed on the PCB board, front and back of the display unit are covered with transparent waterproof membranes, the transparent waterproof membranes are coated on entire surfaces of the PCB board and the LED lamp beads, and the transparent waterproof membrane has a thickness of 5 μm-20 μm;

wherein the PCB board is provided with a plurality of through holes, and the LED lamp beads are set to avoid the through holes, the plurality of through holes are configured to reduce a force-bearing area of the PCB board.

2. The LED screen of claim 1, further comprising an adhesive, wherein the adhesive is positioned around and at the bottom of the LED lamp beads, and is used for bonding the LED lamp beads and PCB board.

3. The LED screen of claim 1, wherein the thickness of the parts of the waterproof membrane covering each LED lamp bead are the same.

4. The LED screen of claim 1, wherein the LED lamp beads are distributed on the PCB board in an array, and the LED lamp beads in the same row in a length direction of the PCB board are arranged at equal intervals, the LED lamp beads in the same column in a width direction of the PCB board are arranged at equal intervals.

5. The LED screen of claim 4, wherein the through hole extends along a width direction or a length direction of the PCB board, and the extension length is at least the distance between two LED lamp beads.

6. The LED screen of claim 5, wherein the through holes are arranged between any two adjacent rows of LED lamp beads, or the through holes are arranged between any two adjacent columns of LED lamp beads.

7. The LED screen of claim 1, wherein the box frame comprises a control rack, box stiffener, positioning pin, hoisting lock, handle, spring lock and angle block, the control rack is arranged in the middle in a length direction of the box frame, the control rack is provided with a control device, the box stiffeners are connected with two frame edges in a width direction of the box frame, and the positioning pin, the hoisting lock and the handle are all arranged on one frame edge in the width direction of the box frame; the spring lock is arranged on one frame edge in the length direction of the box frame, the angle block is arranged on the other frame edge in the length direction of the box frame, and when two box frames are spliced, the spring lock of one box frame cooperates with the angle block of the other box frame to lock the two box frames.

8. The LED screen of claim 7, further comprising a waterproof and heat-conducting pad, wherein the waterproof and heat-conducting pad is arranged between the PCB board and the box frame, and the waterproof and heat-conducting pad is embedded at one side of the PCB board facing the control device.

* * * * *